US005915486A

United States Patent [19]

Portwood et al.

[11] Patent Number: 5,915,486

[45] **Date of Patent: *Jun. 29, 1999**

[54] CUTTER ELEMENT ADAPTED TO WITHSTAND TENSILE STRESS

[75] Inventors: Gary R. Portwood, Kingwood; Scott D. McDonough, Houston; Dennis Cisneros, Kingwood, all of Tex.

[73] Assignee: Smith International, Inc., Houston, Tex.

[ * ] Notice: This patent is subject to a terminal disclaimer.

[21] Appl. No.: 08/833,366

[22] Filed: Apr. 4, 1997

Related U.S. Application Data

[63] Continuation-in-part of application No. 08/668,109, Jun. 21, 1996, Pat. No. 5,813,485.

[51] Int. Cl.[6] ..... E21B 10/08

[52] U.S. Cl. ..... 175/374; 175/432

[58] Field of Search ..... 175/374, 430, 175/431, 432, 425, 426

[56] References Cited

U.S. PATENT DOCUMENTS

| | | | |
|---|---|---|---|
| 930,759 | 8/1909 | Hughes . | |
| 1,325,944 | 12/1919 | Hughes . | |
| 1,480,014 | 1/1924 | Scott . | |
| 2,104,822 | 1/1938 | Scott | 255/71 |
| 2,203,846 | 6/1940 | Stancliff | 175/375 |
| 2,244,617 | 6/1941 | Hannum | 255/71 |
| 2,333,746 | 11/1943 | Scott et al. | 255/71 |
| 2,363,202 | 11/1944 | Scott | 255/71 |
| 2,527,838 | 10/1950 | Morlan et al. | 255/71 |
| 2,660,405 | 11/1953 | Scott et al. | 255/347 |
| 2,774,570 | 12/1956 | Cunningham | 255/347 |
| 2,804,282 | 8/1957 | Spengler, Jr. | 255/345 |
| 2,851,253 | 9/1958 | Boice | 255/347 |
| 2,887,302 | 5/1959 | Garner | 255/349 |
| 2,907,551 | 10/1959 | Peter | 255/349 |
| 2,927,777 | 3/1960 | Steen | 255/347 |
| 2,927,778 | 3/1960 | Coulter, Jr. | 255/349 |
| 2,939,684 | 6/1960 | Payne | 255/349 |
| 2,990,025 | 6/1961 | Talbert et al. | 175/375 |
| 3,003,370 | 10/1961 | Coulter, Jr. et al. | 76/108 |
| 3,018,835 | 1/1962 | Kucera | 175/378 |
| 3,104,726 | 9/1963 | Davis | 175/331 |
| 3,126,067 | 3/1964 | Schumacher, Jr. | 175/374 |
| 3,223,188 | 12/1965 | Coulter, Jr. et al. | 175/341 |
| 3,389,761 | 6/1968 | Ott | 175/374 |

(List continued on next page.)

OTHER PUBLICATIONS

Liang, D.B., M.K. Keshavan and S.D. McDonough, "The Development of Improved Soft Formation Milled Tooth Bits," *Proceedings of the SPE/IADC Drilling Conference held Feb. 23–25, 1993, Amsterdam, pp. 605–614.*

Smith International, Inc. internal documents; Exhibit A comprises drawings of certain cutter inserts that were included on drill bits sold before Apr. 4, 1997; Exhibit B includes a drawing of a cutter insert that was included on drill bits sold before Apr. 4, 1997; (*See accompanying IDS*).

*Primary Examiner*—Frank S. Tsay

*Attorney, Agent, or Firm*—Conley, Rose & Tayon, P.C.

[57] ABSTRACT

A cutter element having a substantially flat wear face and leading compression and trailing tension zones, wherein the leading compression zone is sharper than the trailing tension zone. Sharpness is defined as either a smaller inside angle at the intersection of a pair of planes or as a smaller radius of curvature. The cutter element of the present invention experiences reduced stress on its trailing portion in the direction of cutting movement and therefore is less subject to extreme impact damage and cyclic fatigue. The present invention can be applied with particular advantage to heel row cutters, but can also be applied to cutters in other rows that primarily ream the borehole wall and cooperatively cut the borehole corner. The present cutter element can be constructed so as to have either a positive or negative rake angle at its leading compression zone, or to have any of a variety of shapes, depending on the characteristics of the formation in which it is to be used.

37 Claims, 13 Drawing Sheets

U.S. PATENT DOCUMENTS

| | | | |
|---|---|---|---|
| 3,401,759 | 9/1968 | White | 175/341 |
| 3,504,751 | 4/1970 | Agoshashvilli et al. | 175/331 |
| 3,743,038 | 7/1973 | Bennett | 175/341 |
| 4,058,177 | 11/1977 | Langford, Jr. et al. | 175/374 |
| 4,086,973 | 5/1978 | Keller et al. | 175/374 |
| 4,108,260 | 8/1978 | Bozarth | 175/374 |
| 4,262,761 | 4/1981 | Crow | 175/374 |
| 4,334,586 | 6/1982 | Schumacher | 175/374 |
| 4,604,106 | 8/1986 | Hall et al. | 51/293 |
| 4,629,373 | 12/1986 | Hall | 407/118 |
| 4,694,918 | 9/1987 | Hall | 175/329 |
| 4,716,977 | 1/1988 | Huffstutler | 175/410 |
| 4,726,432 | 2/1988 | Scott et al. | 175/375 |
| 4,811,801 | 3/1989 | Salesky et al. | 175/329 |
| 4,832,139 | 5/1989 | Minikus et al. | 175/374 |
| 4,836,307 | 6/1989 | Keshavan et al. | 175/374 |
| 5,027,913 | 7/1991 | Nguyen | 175/336 |
| 5,051,112 | 9/1991 | Keshavan et al. | 51/309 |
| 5,131,480 | 7/1992 | Lockstedt et al. | 175/374 |
| 5,145,016 | 9/1992 | Estes | 175/331 |
| 5,152,194 | 10/1992 | Keshavan et al. | 76/108.2 |
| 5,172,777 | 12/1992 | Siracki et al. | 175/374 |
| 5,172,779 | 12/1992 | Siracki et al. | 175/420 |
| 5,197,555 | 3/1993 | Estes | 175/431 |
| 5,201,376 | 4/1993 | Williams | 175/374 |
| 5,287,936 | 2/1994 | Grimes et al. | 175/331 |
| 5,311,958 | 5/1994 | Isbell et al. | 175/341 |
| 5,322,138 | 6/1994 | Siracki | 175/374 |
| 5,323,865 | 6/1994 | Isbell et al. | 175/378 |
| 5,341,890 | 8/1994 | Cawthorne et al. | 175/374 |
| 5,346,026 | 9/1994 | Pessier et al. | 175/331 |
| 5,351,768 | 10/1994 | Scott et al. | 175/374 |
| 5,351,769 | 10/1994 | Scott et al. | 175/374 |
| 5,351,770 | 10/1994 | Cawthorne et al. | 175/374 |
| 5,351,771 | 10/1994 | Zahradnik | 175/374 |
| 5,353,885 | 10/1994 | Hooper et al. | 175/378 |
| 5,407,022 | 4/1995 | Scott et al. | 175/331 |
| 5,415,244 | 5/1995 | Portwood | 175/374 |
| 5,421,423 | 6/1995 | Huffstutler | 175/374 |
| 5,421,424 | 6/1995 | Portwood et al. | 175/374 |
| 5,445,231 | 8/1995 | Scott et al. | 175/374 |
| 5,479,997 | 1/1996 | Scott et al. | 175/374 |
| 5,492,186 | 2/1996 | Overstreet et al. | 175/374 |
| 5,542,485 | 8/1996 | Pessier | 175/371 |
| 5,579,856 | 12/1996 | Bird | 175/375 |
| 5,592,995 | 1/1997 | Scott et al. | 175/374 |

CUTTER ELEMENT ADAPTED TO WITHSTAND TENSILE STRESS

CROSS-REFERENCE TO RELATED APPLICATIONS

The present application is a continuation-in-part of U.S. application Ser. No. 08/668,109, filed Jun. 21, 1996, now U.S. Pat. No. 5,813,485 the disclosure of which is hereby incorporated herein by reference.

STATEMENT REGARDING FEDERALLY SPONSORED RESEARCH OR DEVELOPMENT

Not applicable.

FIELD OF THE INVENTION

The invention relates generally to earth-boring bits used to drill a borehole for the ultimate recovery of oil, gas or minerals. More particularly, the invention relates to rolling cone rock bits having cutting elements, and to a more durable structure and shape for such elements. Still more particularly, the invention relates to cutting element having a borehole-engaging leading compression zone that is sharper than its trailing tension zone.

BACKGROUND OF THE INVENTION

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole formed in the drilling process will have a diameter generally equal to the diameter or "gage" of the drill bit.

A typical earth-boring bit includes one or more rotatable cutters that perform their cutting function due to the rolling movement of the cutters acting against the formation material. The cutters roll and slide upon the bottom of the borehole as the bit is rotated, the cutters thereby engaging and disintegrating the formation material in its path. The rotatable cutters may be described as generally conical in shape and are therefore sometimes referred to as rolling cones. Such bits typically include a bit body with a plurality of journal segment legs. The cone cutters are mounted on bearing pin shafts which extend downwardly and inwardly from the journal segment legs. The borehole is formed as the gouging and scraping or crushing and chipping action of the rotary cones remove chips of formation material which are carried upward and out of the borehole by drilling fluid which is pumped downwardly through the drill pipe and out of the bit.

The earth disintegrating action of the rolling cone cutters is enhanced by providing the cutters with a plurality of cutter elements. Cutter elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits, while those having teeth formed from the cone material are known as "steel tooth bits." In each case, the cutter elements on the rotating cutters break up the formation to form new borehole by a combination of gouging and scraping or chipping and crushing.

The cost of drilling a borehole is proportional to the length of time it takes to drill to the desired depth and location. The time required to drill the well, in turn, is greatly affected by the number of times the drill bit must be changed in order to reach the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer and which are usable over a wider range of formation hardness.

The length of time that a drill bit may be employed before it must be changed depends upon its rate of penetration ("ROP"), as well as its durability or ability to maintain an acceptable ROP. As is apparent, dull, broken or worn cutter elements cause a decrease in ROP. The form and positioning of the cutter elements (both steel teeth and TCI inserts) upon the cone cutters greatly impact bit durability and ROP and thus are critical to the success of a particular bit design.

Bit durability is, in part, also measured by a bit's ability to "hold gage," meaning its ability to maintain a full gage borehole diameter over the entire length of the borehole. Gage holding ability is particularly vital in directional drilling applications which have become increasingly important. If gage is not maintained at a relatively constant dimension, it becomes more difficult, and thus more costly, to insert drilling apparatus into the borehole than if the borehole had a constant diameter. For example, when a new, unworn bit is inserted into an undergage borehole, the new bit will be required to ream the undergage hole as it progresses toward the bottom of the borehole. Thus, by the time it reaches the bottom, the bit may have experienced a substantial amount of wear that it would not have experienced had the prior bit been able to maintain full gage. This unnecessary wear will shorten the bit life of the newly-inserted bit, thus prematurely requiring the time consuming and expensive process of removing the drill string, replacing the worn bit, and reinstalling another new bit downhole.

To assist in maintaining the gage of a borehole, conventional rolling cone bits typically employ a heel row of hard metal inserts on the heel surface of the rolling cone cutters. The heel surface is a generally frustoconical surface and is configured and positioned so as to generally align with and ream the sidewall of the borehole as the bit rotates. The inserts in the heel surface contact the borehole wall with a sliding motion and thus generally may be described as scraping or reaming the borehole sidewall. The heel inserts function primarily to maintain a constant gage and secondarily to prevent the erosion and abrasion of the heel surface of the rolling cone. Excessive wear of the heel inserts leads to an undergage borehole, decreased ROP and increased loading on the other cutter elements on the bit, and may accelerate wear of the cutter bearing and ultimately lead to bit failure.

In addition to the heel row inserts, conventional bits typically include a gage row of cutter elements mounted adjacent to the heel surface but orientated and sized in such a manner so as to cut the corner of the borehole. Conventional bits also include a number of additional rows of cutter elements that are located on the cones in rows disposed radially inward from the gage row. These cutter elements are sized and configured for cutting the bottom of the borehole and are typically described as inner row cutter elements.

Each cutter element on the bit has what is commonly termed a leading face or edge and a trailing face or edge. The leading face or edge is defined as that portion of the cutting surface of the cutter element that first contacts the formation as the bit rotates. The trailing face or edge is the portion of the cutter opposite the leading face or edge and is the last portion of the cutter element to contact the formation.

Similarly, it has been found that the stresses produced in each cutter element during a cutting cycle are not equal across the body of the cutter. More specifically, wear studies on used bits and computer modeling of cutting paths have shown that each cutter element has a portion that has been subjected to compressive stress in the direction of cutting movement and another portion that has been subjected to primarily tensile stress in the direction of cutting movement. It is frequently the case that the leading edge of a cutter element is also the portion of the cutter that is subjected to the greatest compressive stress in the direction of cutting movement. Similarly, it is often the trailing edge of a cutter element that is subjected to the greatest tensile stress in the direction of cutting movement.

The term "leading compression zone" will be used hereinafter to refer to the portion of a cutter element that is subjected to large compressive stress, and the term "trailing tension zone" will be used hereinafter to refer to the portion of a cutter element that is subjected to large tensile stress, regardless of whether the section so referred to is planar, contoured or includes an edge. Because the precise portion of the cutter element meeting each definition varies not only with bit design and cutter element design, but also with movement of the rolling cone, it will be understood by those skilled in the art that the terms "compression" and "tension" are functional and are each meant to be defined in terms of the operation of the drill bit and cutter element itself.

It has been found that, in a given cutter element, the trailing tension zone is typically subject to earlier failure than the leading compression zone, regardless of whether those zones are planar, contoured or have a defined "face" or "edge". This is particularly true with respect to heel row cutter elements. The predominant failure mode of the trailing tension zone, and ultimately of the whole cutter element, is the result of excessive friction along the trailing tension zone and of tensile stresses that are localized in the trailing tension zone. Unlike the leading compression zone, the trailing tension zone of the cutter element does not play an active role in shearing or reaming of the borehole wall, and is therefore subjected to significantly smaller compressive forces in the direction of its cutting movement (even though this trailing tension zone does experience compressive loading in the direction perpendicular to the hole wall). Instead, as a result of frictional contact with the borehole wall, the trailing section is subjected to tensile loads, which induce stress. Inserts coated with superabrasive materials, such as polycrystalline diamond ("PCD") and polycrystalline cubic boron nitride ("PCBN"), are adversely affected by the application of tensile stress, although uncoated inserts can also suffer damage on the unsupported trailing tension zone. Because diamond is relatively brittle, unsupported or poorly supported areas of diamond coating tend to crack and break off, leaving the insert unprotected. Diamond coated inserts are better suited to withstand wear and frictional heat compared to uncoated inserts, but are adversely affected by the application of loads that induce tensile stress.

SUMMARY OF THE INVENTION

The present invention provides a novel cutter element for an earth boring bit that avoids damage that is typically caused by tensile stresses in conventional cutter elements. The present cutter element includes a leading compression zone that is sharper than its trailing tension zone. By providing a trailing tension zone that is better supported and therefore able to better withstand tensile stress, the overall life of both the cutter element and the drill bit are improved.

The present invention further provides an earth boring bit for drilling a borehole of a predetermined gage, the bit providing increased durability, ROP and footage drilled (at full gage) as compared with similar bits of conventional technology. The bit includes a bit body and one or more rolling cone cutters rotatably mounted on the bit body. The rolling cone cutter includes a generally conical surface, an adjacent heel surface, and preferably a circumferential shoulder therebetween. Each of the heel, conical and shoulder surfaces may support a plurality of cutter elements that are adapted to cut into the formation so as to produce the desired borehole.

According to the invention, the cutter elements may be hard metal inserts having cutting portions attached to generally cylindrical base portions which are mounted in the cone cutter, or may comprise steel teeth that are milled, cast, or otherwise integrally formed from the cone material. In either case, the present cutter elements are configured and formed so as to reduce tensile stresses on the trailing tension zone. This is accomplished by increasing the angle at which the trailing face of the cutter element intersects the wear face of the cutter element, or by increasing the radius between the two faces, or by a combination of both. This design enables the cutter elements to withstand longer use, so as to enhance ROP, bit durability and footage drilled at full gage.

In one embodiment of the present invention, inserts are formed having substantially frustoconical, curved leading and trailing faces, which intersect the wear face of the cutter element at a curved edge. The insert is configured in accordance with the principles of the present invention such that the inside angle at which the curved leading face intersects the wear face is less than the inside angle at which the curved trailing face intersects the wear face.

In another embodiment of the invention, the sides of the present insert may be contoured, with the transitions between the leading and trailing faces and the wear face being rounded. In this embodiment, the leading compression zone is made sharper than the trailing tension zone by providing the leading compression zone with a smaller radius of curvature than the radius of curvature of the trailing tension zone.

In still another embodiment, a cutter element having contoured sides and rounded transitions and having a leading compression zone sharper than its trailing tension zone also has a beveled or relieved sub-zone within its trailing tension zone. More specifically, a portion of the cutter element that is subject to particularly great tensile stresses in the direction of cutting movement is reduced in a manner that still provides a well-supported cutting face.

BRIEF DESCRIPTION OF THE DRAWINGS

For an introduction to the detailed description of the preferred embodiments of the invention, reference will now be made to the accompanying drawings, wherein.

Figure 1:
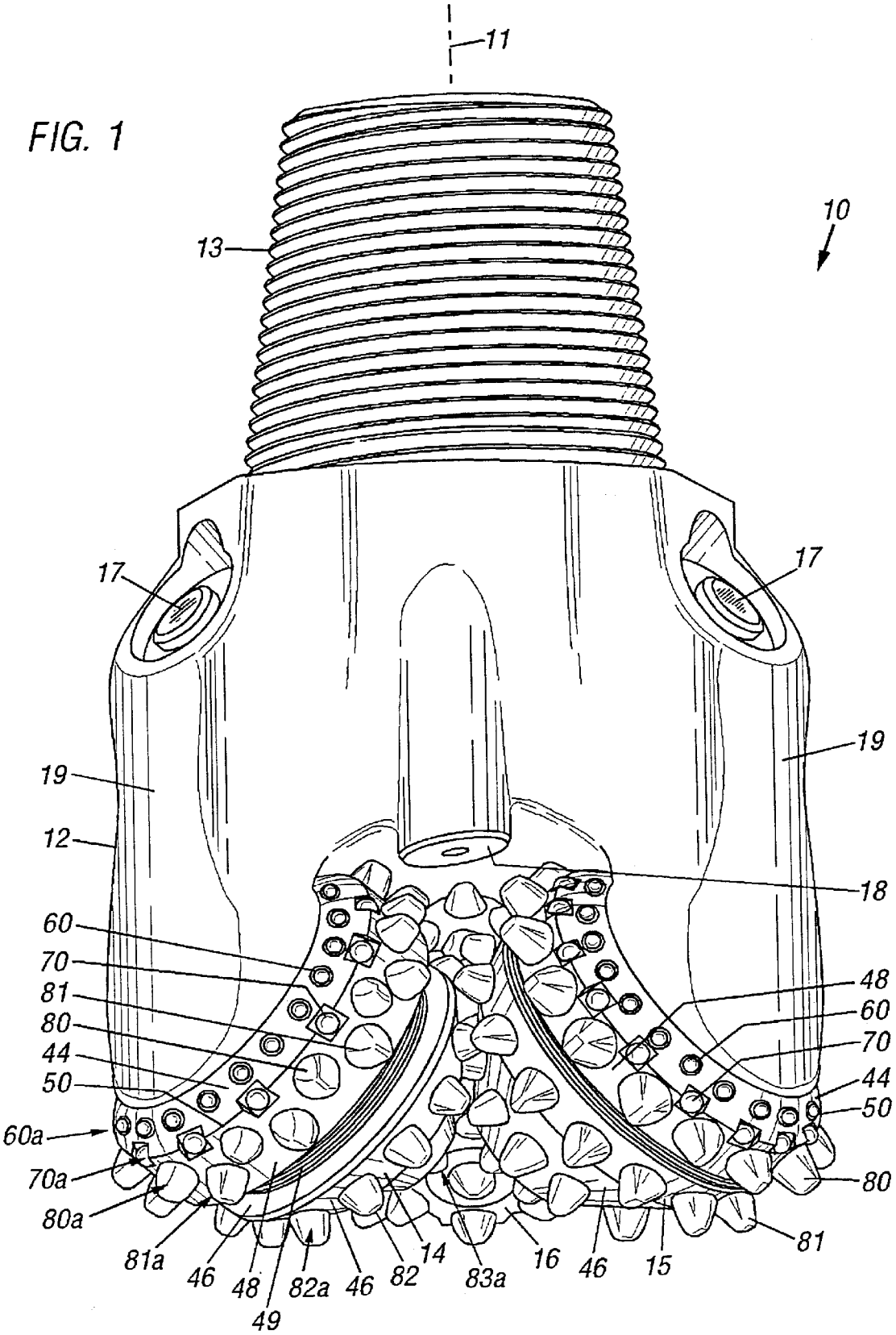
FIG. 1 is a perspective view of an earth boring bit constructed in accordance with the principles of the present invention.
Figure 1A:
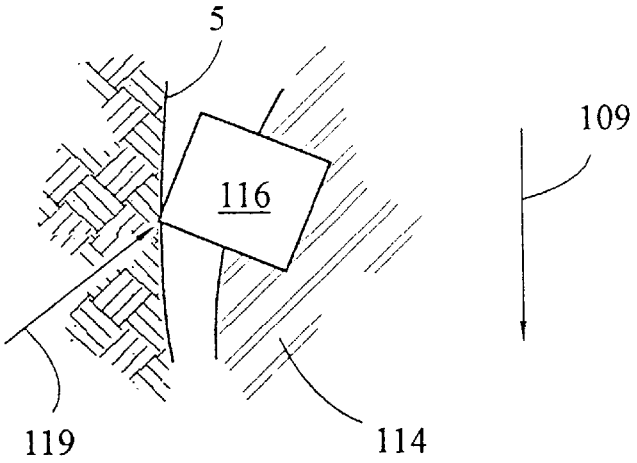
FIGS. 1A–C are enlarged schematic views of a single cutter element at different stages of engagement with a borehole wall.
Figure 1B:
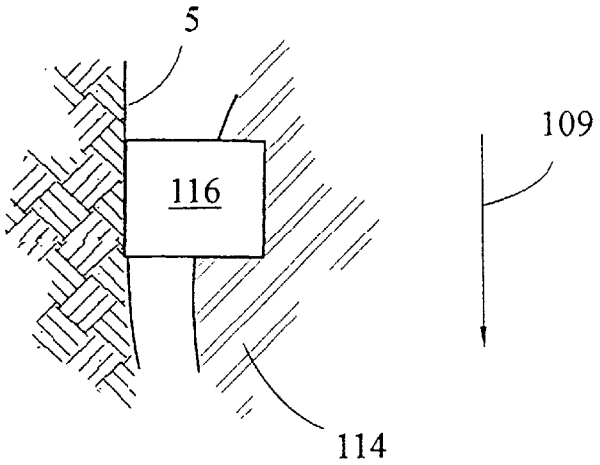
Figure 1C:
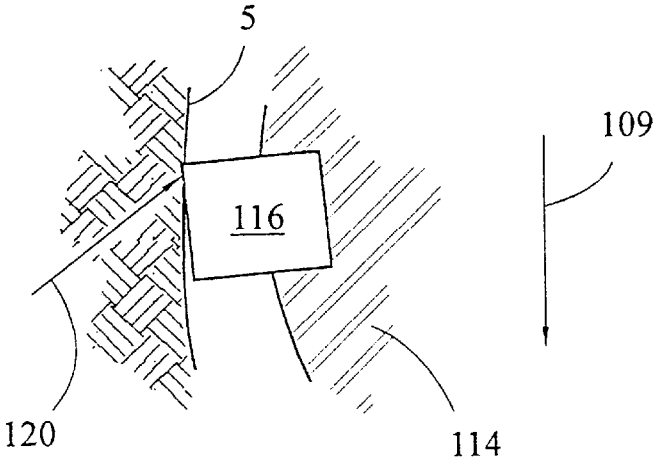
Figure 1E:
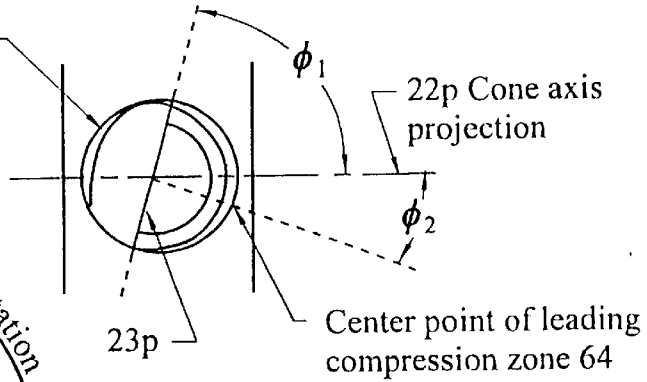
FIG. 1D is a plan view of a single rolling cone of the bit of FIG. 1, the view taken along the bit axis (the "z" axis)
Figure 1D:
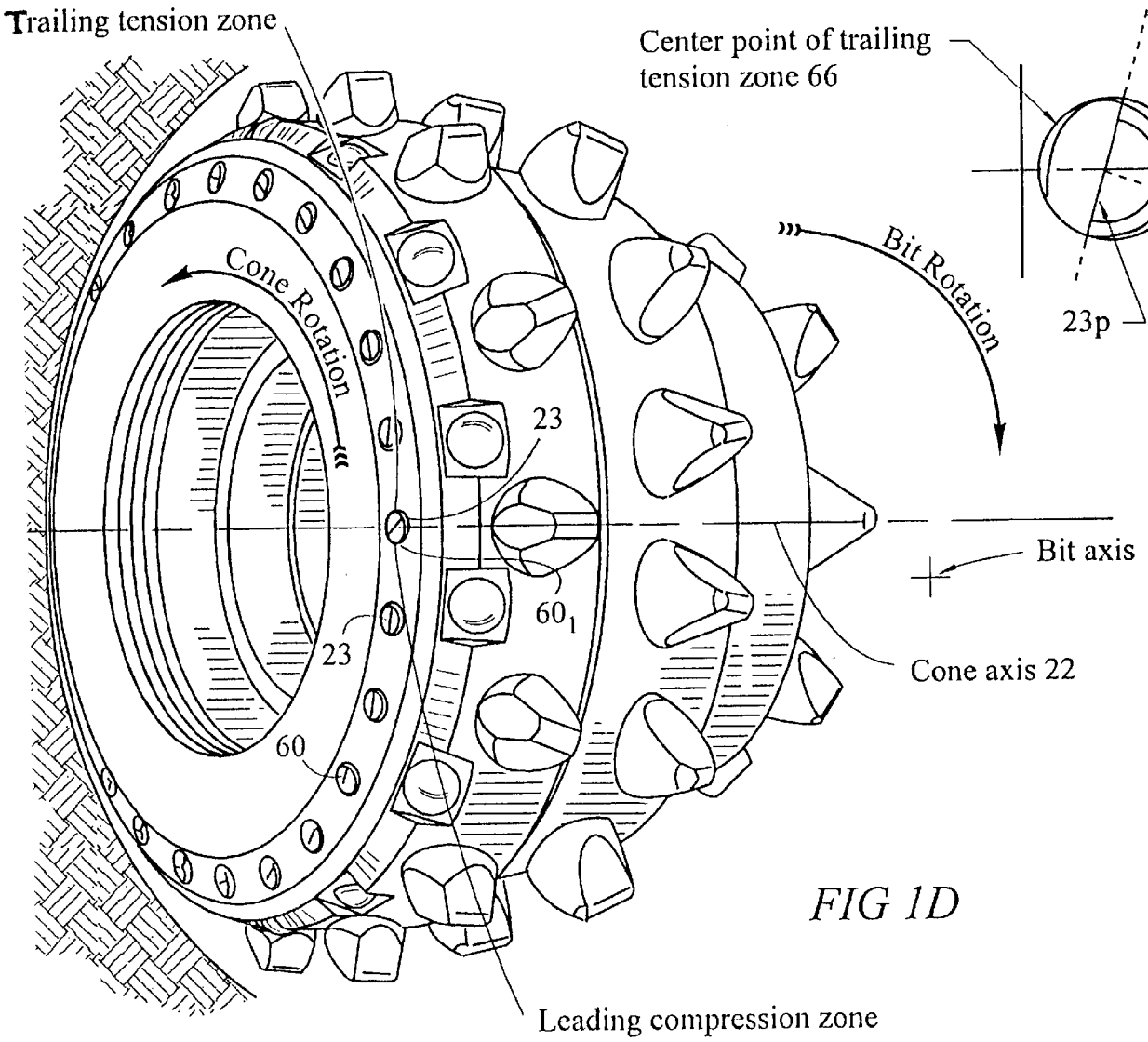
Figure 2:
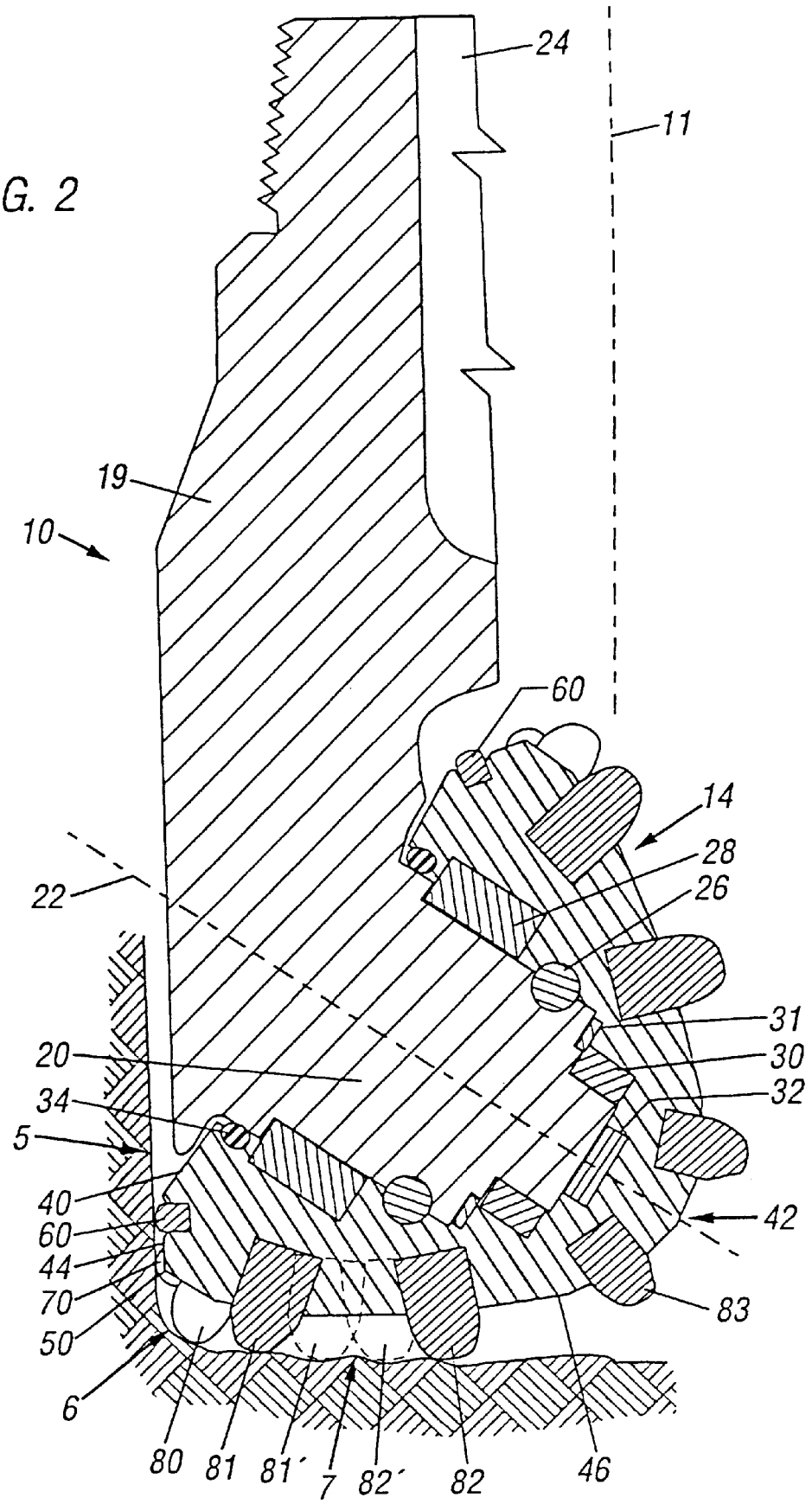
Figure 3:
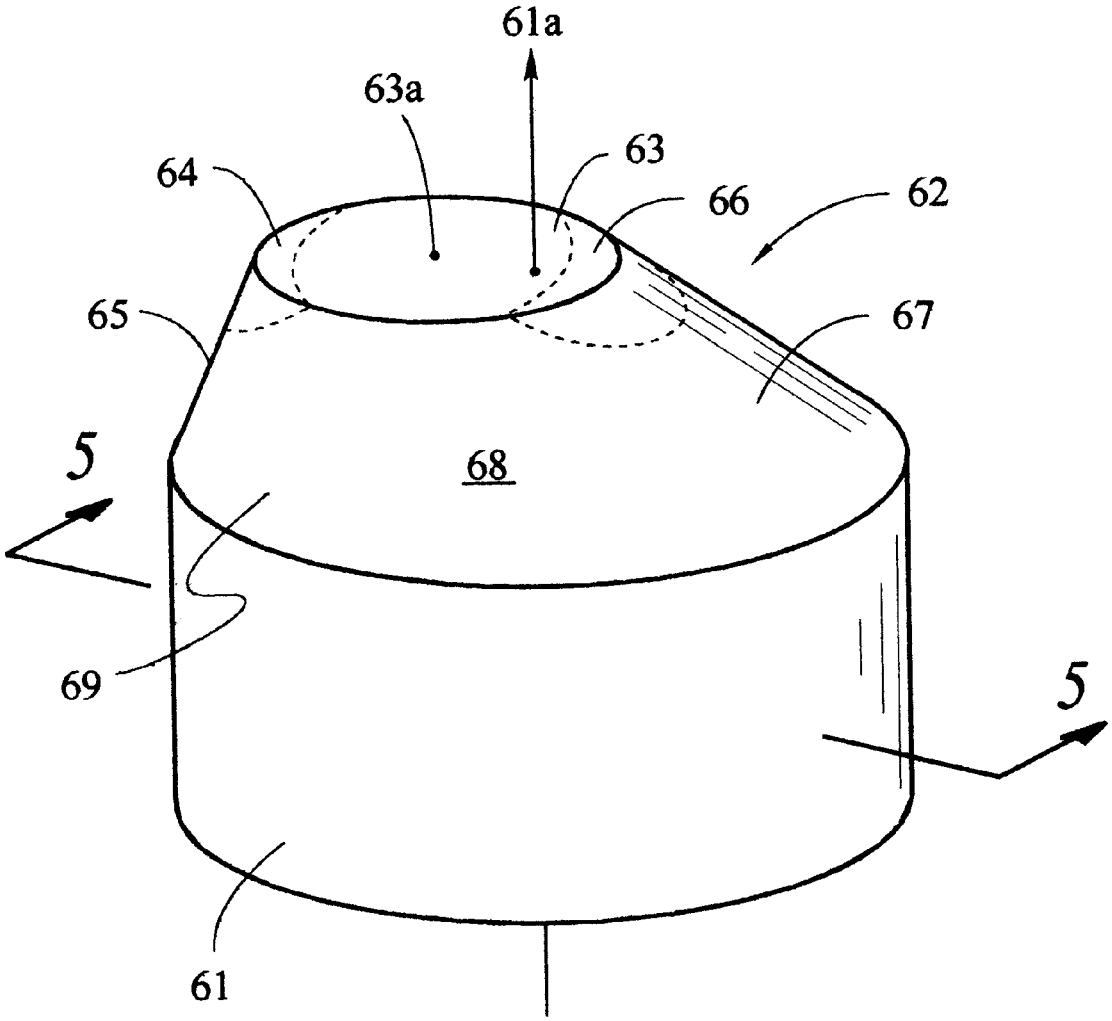
Figure 4:
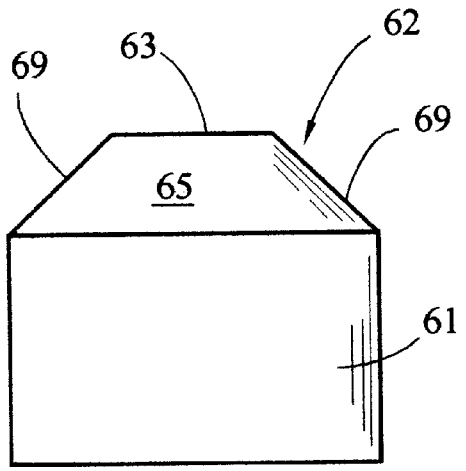
Figure 5:
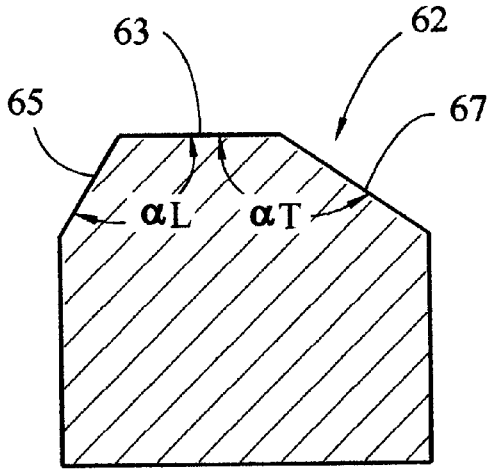
Figure 6:
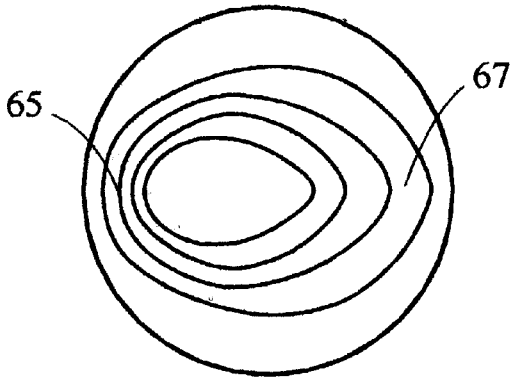
Figure 7:
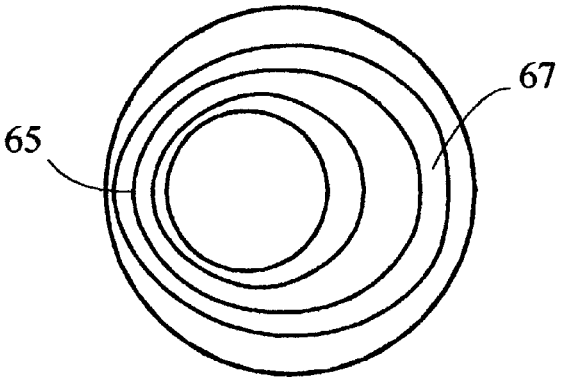
Figure 8:
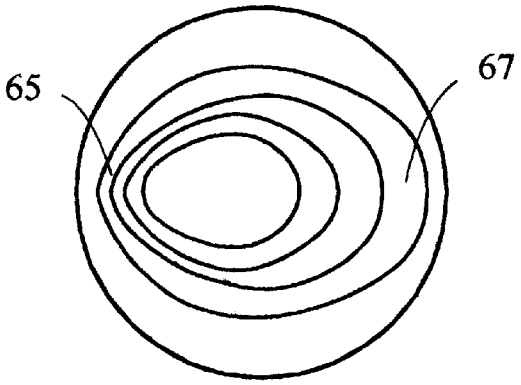
Figure 9:
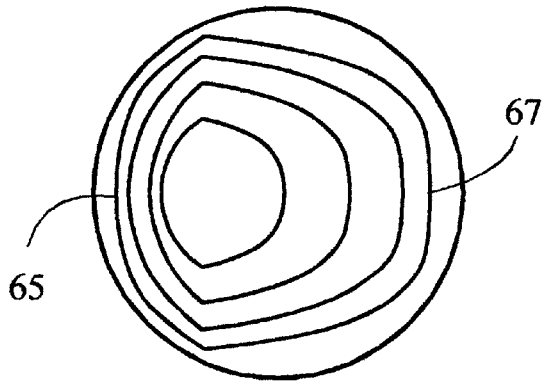
Figure 11:
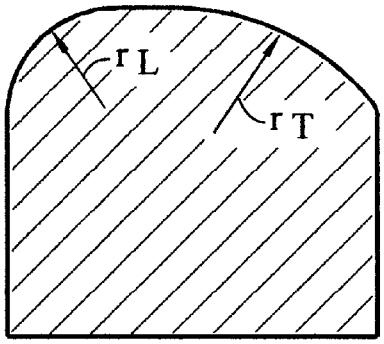
Figure 12:
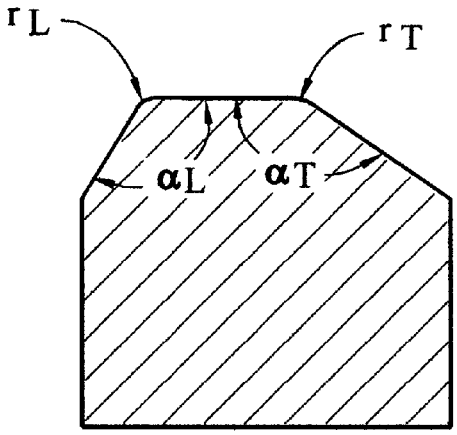
Figure 10:
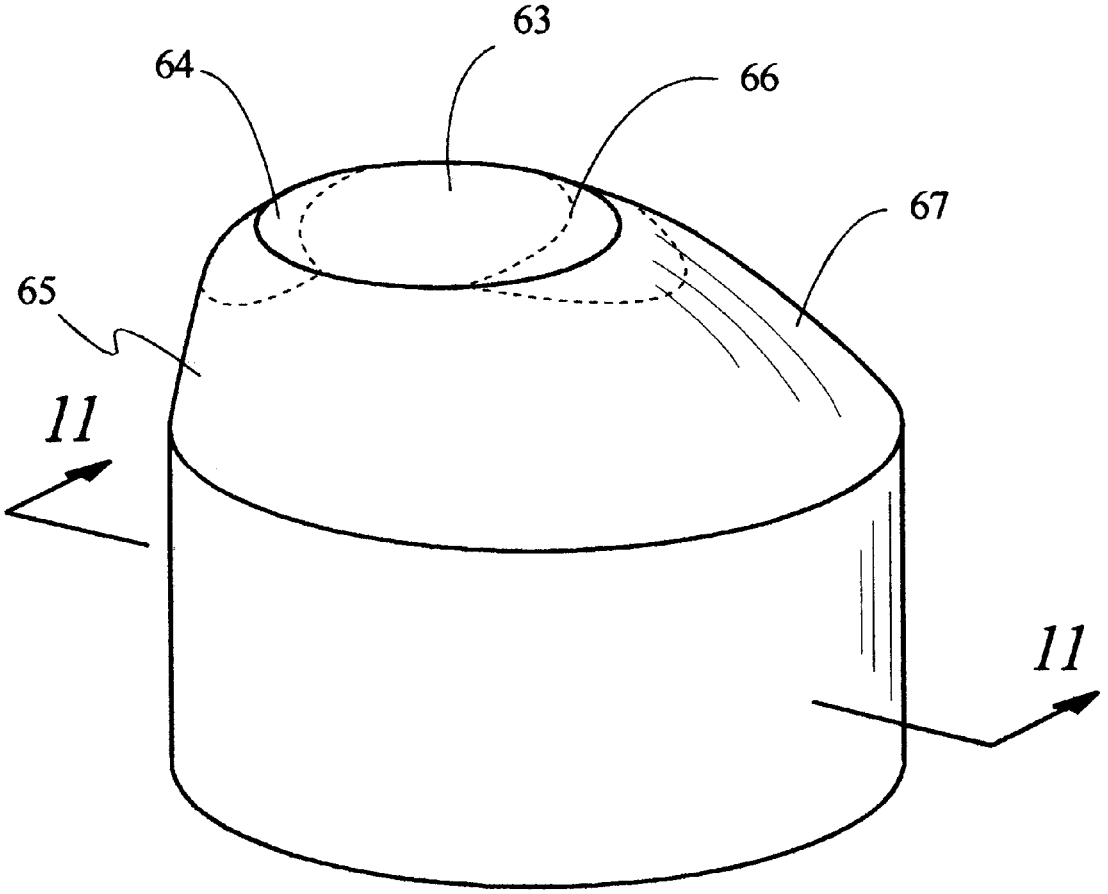
Figure 13A:
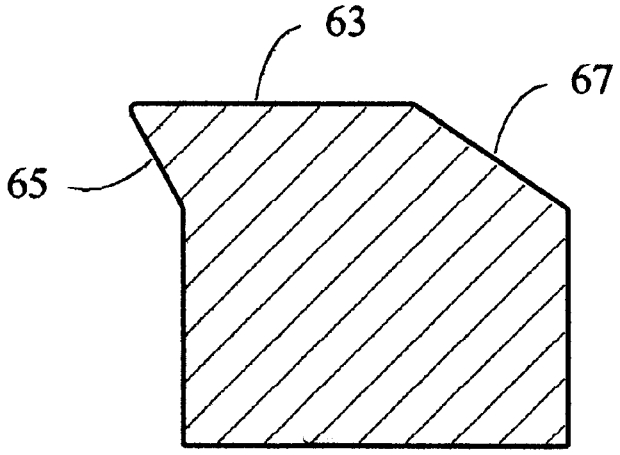
Figure 14:
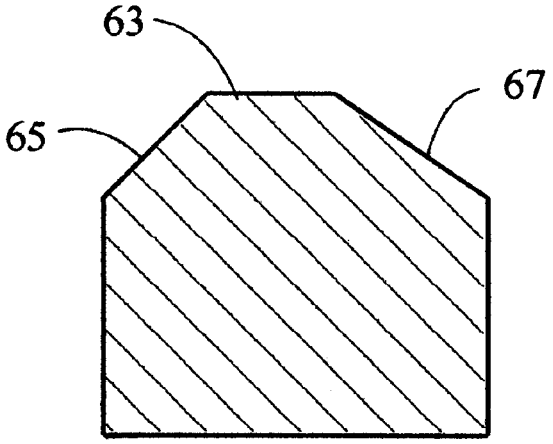
Figure 15:
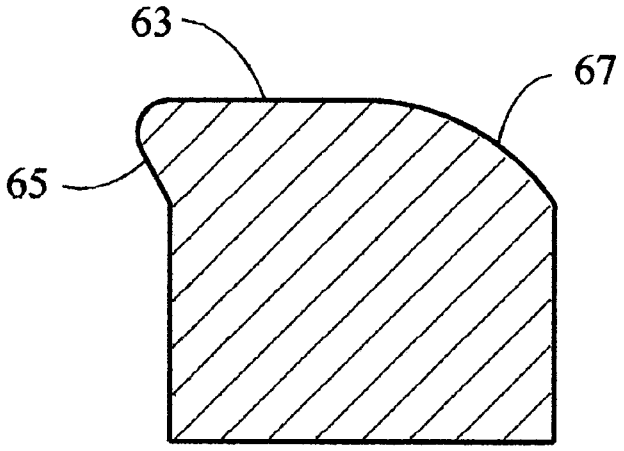
Figure 13B:
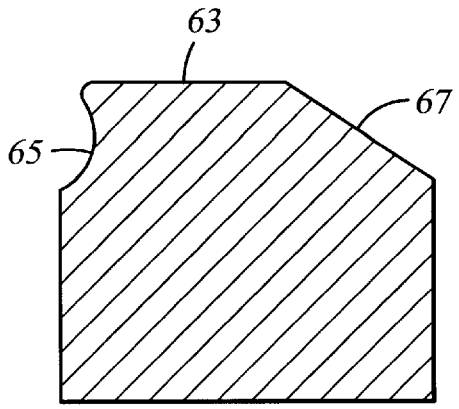
Figure 16:
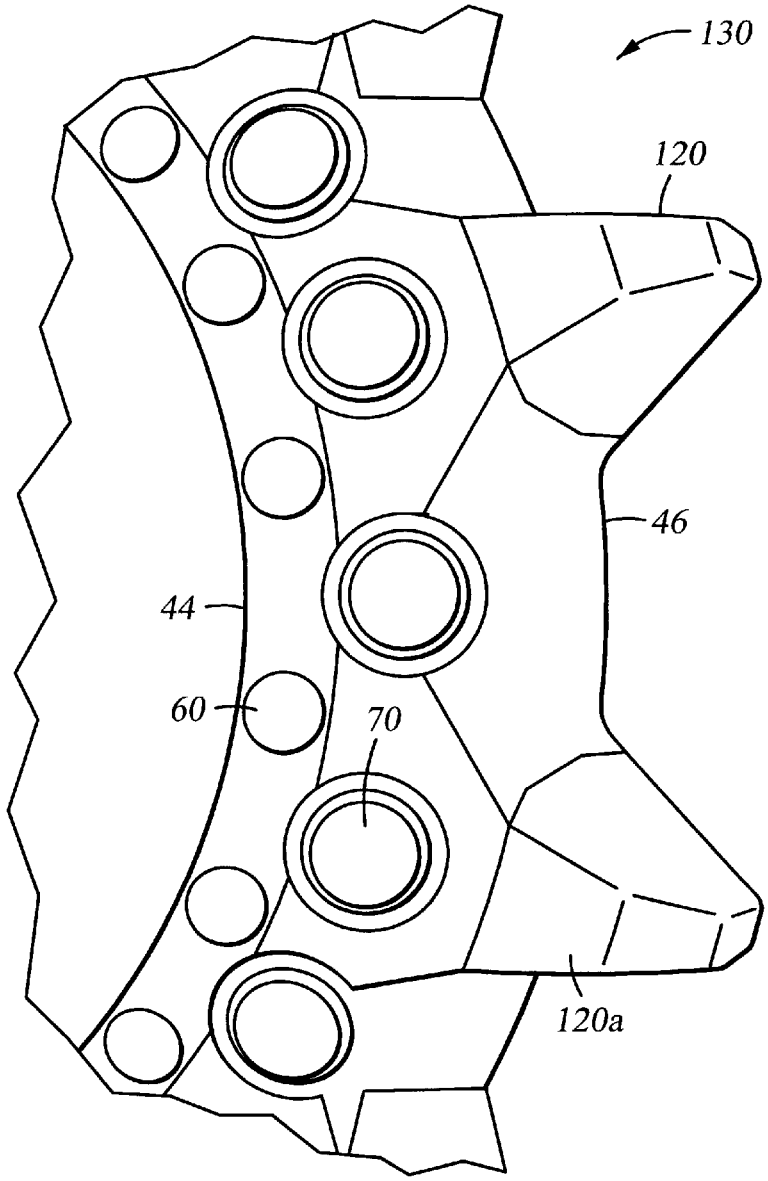
Figure 18:
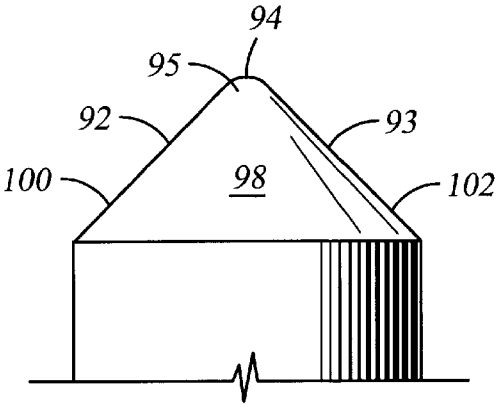
Figure 17A:
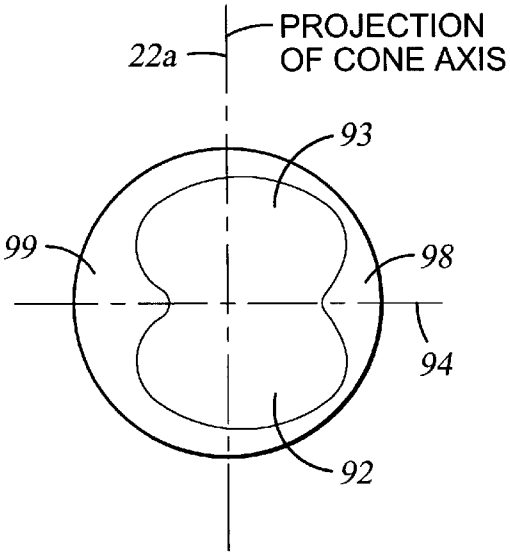
Figure 17:
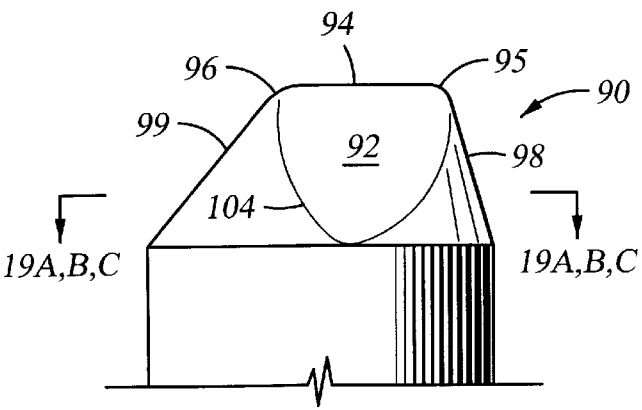
Figure 19A:
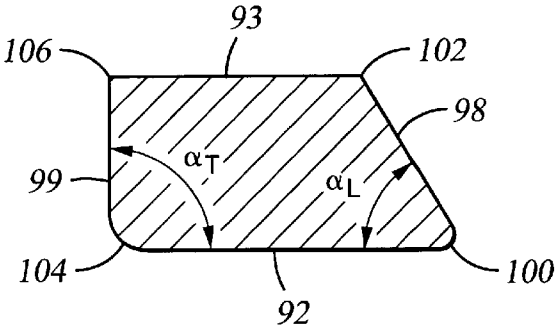
Figure 19A:
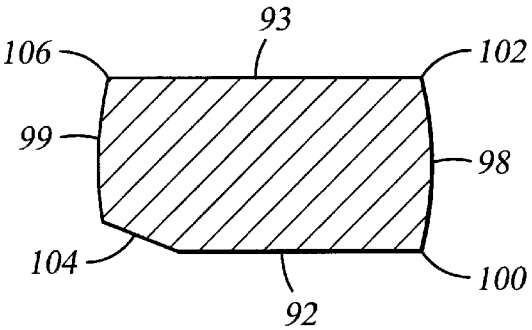
Figure 19A:
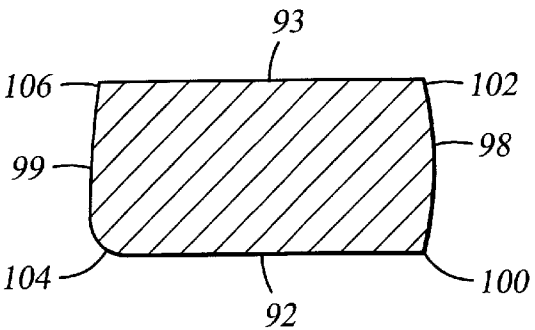
Figure 23:
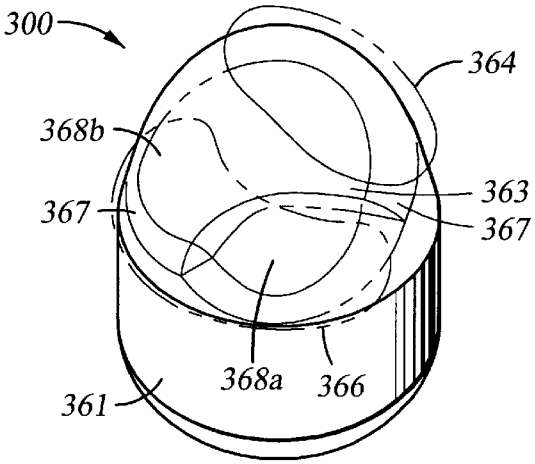
Figure 24:
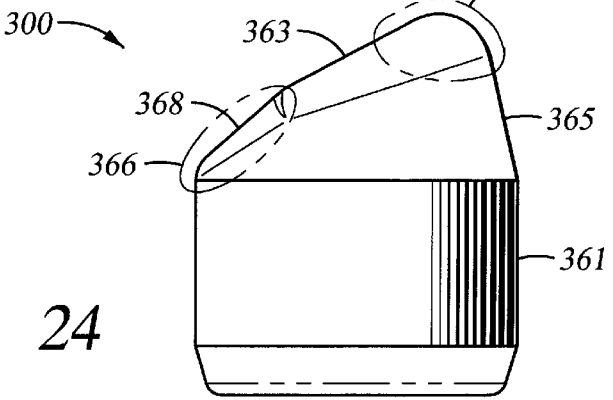
Figure 20:
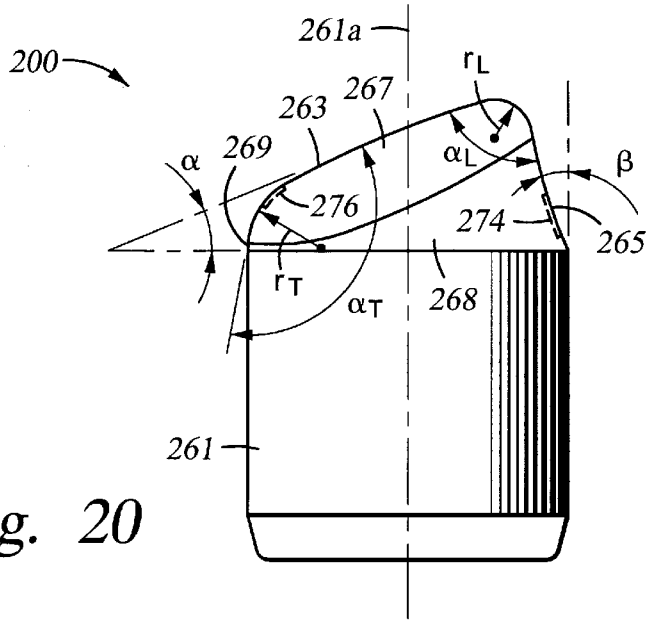
Figure 21:
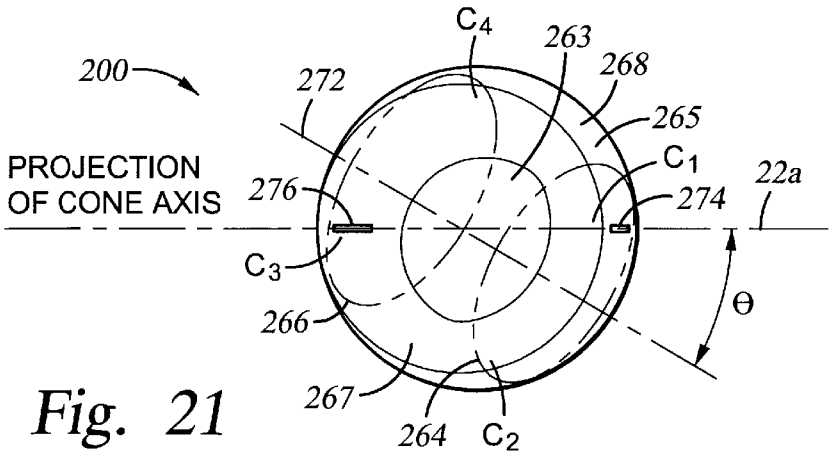
Figure 22:
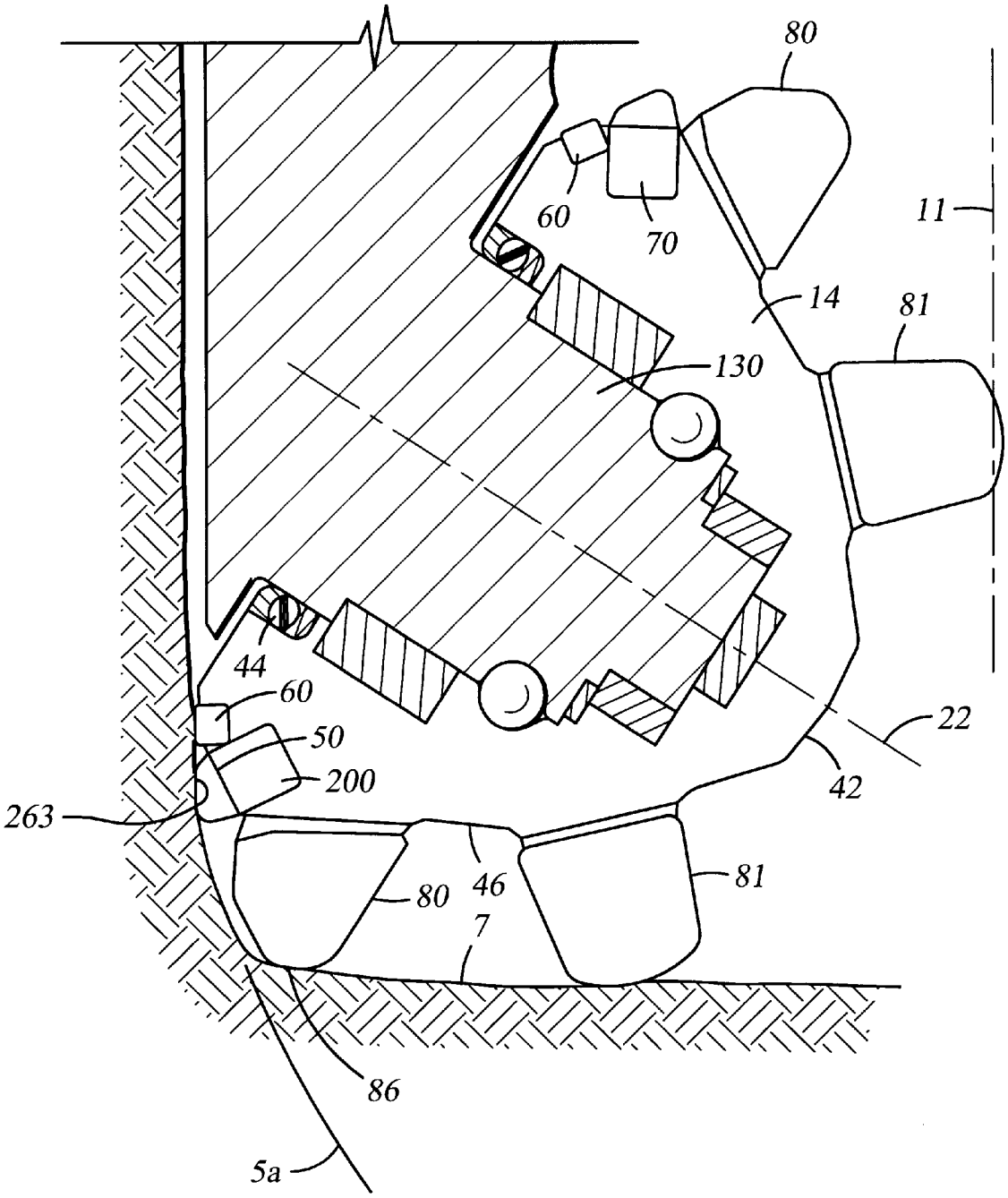

from the pin end of the bit and showing a projection of the cone axis onto a plane perpendicular to the bit axis;

FIG. 1E is an enlarged view of a single cutter element from FIG. 1D, showing a preferred alternative orientation of the leading compression zone and trailing tension zone of a cutter element constructed in accordance with the principles of the present invention with respect to a projection of the cone axis;

FIG. 2 is a partial section view taken through one leg and one rolling cone cutter of the bit shown in FIG. 1;

FIG. 3 is a perspective view of a single cutter element constructed in accordance with the principles of the present invention;

FIG. 4 is a front elevation of the present cutter element as viewed along lines 4—4 of FIG. 3;

FIG. 5 is a section view taken along lines 5—5 of FIG. 3;

FIG. 6 is a plan view of the cutter element shown in FIG. 3 including contour lines;

FIG. 7 is a plan view of a first alternative embodiment of the present cutter element including contour lines;

FIG. 8 is a plan view of a second alternative embodiment of the present cutter element including contour lines;

FIG. 9 is a plan view of a third alternative embodiment of the present cutter element including contour lines;

FIG. 10 is a perspective view of a fourth alternative embodiment of the present cutter element;

FIG. 11 is a section view taken along lines 11—11 of FIG. 10;

FIG. 12 is a section view of a fifth alternative embodiment of the present cutter element;

FIG. 13A is a section view of a sixth alternative embodiment of the present cutter element;

FIG. 13B is a section view of a seventh alternative embodiment of the present cutter element;

FIG. 14 is a section view of an eighth alternative embodiment of the present cutter element;

FIG. 15 is a section view of a ninth alternative embodiment of the present cutter element;

FIG. 16 is a perspective view of a steel tooth cone cutter incorporating the cutter element of the present invention;

FIG. 17 is a side elevation of still another alternative embodiment of the present cutter element;

FIG. 17A is a plan view of the cutter element of FIG. 17, showing a preferred orientation of the cutter element with respect to a projection of the cone axis;

FIG. 18 is a front elevation of the embodiment shown in FIG. 17;

FIGS. 19A,B,C are cross-sectional views taken along lines 19—19 of FIG. 17, showing alternative embodiments of the cross section of the cutter element shown in FIG. 17;

FIG. 20 is a side view of another alternative preferred embodiment of another cutter according to the present invention; and FIG. 21 is a plan view of the cutter element of FIG. 20, showing a preferred orientation of the cutter element with respect to a projection of the cone axis;

FIG. 22 is an enlarged, partially cross-sectional view of a portion of the cutting structure of the cone cutter shown in FIG. 16 and showing the cutter element of FIGS. 20 and 21 positioned in a nestled gage row; and FIGS. 23 and 24 are perspective and side views, respectively, of an alternative embodiment of the cutter element of FIG. 20.

DETAILED DESCRIPTION OF THE PREFERRED EMBODIMENTS

Referring first to FIG. 1, an earth-boring bit 10 made in accordance with the present invention includes a central axis 11 and a bit body 12 having a threaded section 13 on its upper end for securing the bit to the drill string (not shown). Bit 10 has a predetermined gage diameter as defined by three rolling cone cutters 14, 15, 16 rotatably mounted on bearing shafts that depend from the bit body 12. Bit body 12 is composed of three sections or legs 19 (two shown in FIG. 1) that are welded together to form bit body 12. Bit 10 further includes a plurality of nozzles 18 that are provided for directing drilling fluid toward the bottom of the borehole and around cutters 14–16. Bit 10 further includes lubricant reservoirs 17 that supply lubricant to the bearings of each of the cutters.

Referring now to FIG. 2, in conjunction with FIG. 1, each rolling cone cutter 14–16 is rotatably mounted on a pin or journal 20, with an axis of rotation 22 orientated generally downwardly and inwardly toward the center of the bit. Drilling fluid is pumped from the surface through fluid passage 24 where it is circulated through an internal passageway (not shown) to nozzles 18 (FIG. 1). Each cutter 14–16 is typically secured on pin 20 by locking balls 26. In the embodiment shown, radial and axial thrust are absorbed by roller bearings 28, 30, thrust washer 31 and thrust plug 32; however, the invention is not limited to use in a roller bearing bit, but may equally be applied in a friction bearing bit. In such instances, the cones 14, 15, 16 would be mounted on pins 20 without roller bearings 28, 30. In both roller bearing and friction bearing bits, lubricant may be supplied from reservoir 17 to the bearings by apparatus that is omitted from the figures for clarity. The lubricant is sealed and drilling fluid excluded by means of an annular seal 34. It is again to be understood that the invention is not limited to a particular bearing or seal structure. The invention may likewise be employed in unsealed bits and in bits that have air cooled bearings.

The borehole created by bit 10 includes sidewall 5, corner portion 6 and bottom 7, best shown in FIG. 2. Referring still to FIGS. 1 and 2, each rolling cone cutter 14–16 includes a backface 40 and nose portion 42 spaced apart from backface 40. Rolling cone cutters 14–16 each further include a frustoconical surface 44 that is adapted to retain cutter elements that scrape or ream the sidewall of the borehole as rolling cone cutters 14–16 rotate about the borehole bottom. Frustoconical surface 44 will be referred to herein as the "heel" surface of cutters 14–16, it being understood, however, that the same surface may be sometimes referred to by others in the art as the "gage" surface of a rolling cone cutter.

Extending between heel surface 44 and nose 42 is a generally conical surface 46 adapted for supporting cutter elements that gouge or crush the borehole bottom 7 as the cone cutters rotate about the borehole. Conical surface 46 typically includes a plurality of generally frustoconical segments 48 (FIG. 1) generally referred to as "lands" which are employed to support and secure the cutter elements as described in more detail below. Grooves 49 (FIG. 1) are formed in cone surface 46 between adjacent lands 48. Frustoconical heel surface 44 and conical surface 46 converge in a circumferential edge or shoulder 50. Although referred to herein as an "edge" or "shoulder," it should be understood that shoulder 50 may be contoured, such as a radius, to various degrees such that shoulder 50 will define a contoured zone of convergence between frustoconical heel surface 44 and the conical surface 46.

In the embodiment of the invention shown in FIGS. 1 and 2, each rolling cone cutter 14–16 includes a plurality of wear resistant inserts 60, 70, 80. Inserts 60, 70, 80 include generally cylindrical base portions that are secured by interference fit into mating sockets drilled into the lands of the rolling cone cutters, and cutting portions that are connected to the base portions and have cutting surfaces for cutting formation material that extend from cone surfaces 44, 46 or shoulder 50. The present invention will be understood with reference to one such rolling cone cutter 14, cones 15, 16 being similarly, although not necessarily identically, configured.

As best shown in FIG. 1, rolling cone cutter 14 includes a plurality of heel row inserts 60 that are secured in a circumferential row 60*a* in the frustoconical heel surface 44. Cutter 14 preferably also includes a circumferential row 70*a* of nestled inserts 70 secured to cutter 14 in locations along or near the circumferential shoulder 50, a circumferential row 80*a* of off-gage inserts 80 secured to cutter 14, and a plurality of inner row inserts 81, 82, 83 secured to cone surface 46 and arranged in spaced-apart inner rows 81*a*, 82*a*, 83*a*, respectively. As understood by those skilled in this art, heel inserts 60 generally function to scrape or ream the borehole sidewall 5 to maintain the borehole at full gage and prevent erosion and abrasion of heel surface 44. Nestled inserts 70 and off gage inserts 80 function primarily to cut the corner of the borehole, in that they cooperate to cut both the sidewall and the bottom of the hole. It is preferred that these cutters 70, 80 be positioned such that nestled inserts 70 extend to full gage and primarily perform sidewall cutting, while off gage inserts 80 are off-gage a predetermined distance and primarily perform bottom hole cutting. Cutter elements 81, 82 and 83 of inner rows 81*a*, 82*a*, 83*a* are employed primarily to gouge and remove formation material from the borehole bottom 7. Inner rows 81*a*, 82*a*, 83*a* are arranged and spaced on rolling cone cutter 14 so as not to interfere with the inner rows on each of the other cone cutters 15, 16. While the present invention is described hereinafter in terms of a heel row insert 60 and nestled row inserts 70, it should be understood that the principle of the present invention can be advantageously applied to other cutter elements in other rows as well, although the advantages of the invention are presently believed most pronounced when employed in cutter elements whose primary function is reaming or sidewall cutting or cooperatively cutting the borehole corner. Further, although it is preferred that inserts 80 be off gage to a predetermined degree, the principles of the present invention are equally applicable where inserts 80 extend to full gage.

FIGS. 3–5 show a first preferred embodiment of the present invention, comprising a novel insert indicated generally by arrow 62. Insert 62 includes a cylindrical base 61 and a cutting surface 68. It should be noted that the base 61 is made in cylindrical form largely because it is the most practical. Other shapes of bases and corresponding sockets could be formed, but since it is more economical to drill circular holes in the cone for receiving base portion 61 of insert 62, cylindrical insert bases are generally preferred. Base 61 includes a longitudinal axis 61*a*. Insert 62 is particularly well suited for use as a heel row insert and will be described as such hereinafter, it being understood that it will also have utility in other positions as well, including as nestled gage inserts 70, for example.

Cutting surface 68 of insert 62 includes a wear face 63 that is adapted to extend beyond heel surface 44 of cone 14, a curved leading face 65, and a curved trailing face 67. Wear face 63 can be slightly convex, concave or flat. Wear face 63 includes a leading compression zone 64 and a trailing tension zone 66, both generally indicated in phantom in FIG. 3. Zone 64 and 66 are represented as generally crescent shaped regions for illustration purposes, although the actual shape of these zones is dependent on many factors, such as bit offset, journal angle, cone geometry, formation being drilled, etc. In any event, wear face 63 further includes a center point 63*a*, defined as the point midway between the leading compression zone 64 and the trailing tension zone 66. Leading compression zone 64 and leading face 65 are generally directly opposite trailing tension zone 66 and trailing face 67 on insert 62. It will be understood that the terms "leading compression zone" and "trailing tension zone" do not refer to any particularly delineated section of the cutting face, but rather to those zones in which the stresses (compressive and tensile, respectively) are most highly concentrated during cutting.

The application of loads inducing compressive and tensile stress in a cutter element can best be understood with reference to FIGS. 1A–C, which schematically show the relationship of a conventional heel insert 116 with respect to the borehole wall 5 as the insert performs its scraping or reaming function. These Figures show the direction of the cutter element movement relative to the borehole wall 5 as represented by arrow 109, this movement being referred to hereinafter as the "cutting movement" of the cutter element. This cutting movement 109 is defined by the geometric parameters of the static cutting structure design (including parameters such as cone diameter, bit offset, and cutter element count and placement), as well as the cutter element's dynamic movement caused by the bit's rotation, the rotation of the cone cutter, and the vertical displacement of the bit through the formation. As shown in FIG. 1A, as the cutting surface of insert 116 first approaches and engages the hole wall, the formation applies forces as represented by arrow 119 inducing primarily compressive stresses in the direction of cutting movement in the leading portion of the insert. As the cone rotates further, the leading portion of insert 116 leaves engagement with the formation and the trailing portion of the insert comes into contact with the formation as shown in FIG. 1C. This causes a reaction force from the hole wall as represented by arrow 120, to be applied to the trailing portion of the insert, which produces tensile stress in the insert. With insert 116 in the position shown in FIG. 1C, it can be seen that the trailing portion of the insert, the portion which experiences significant tensile stress, is not well supported. That is, there is only a relatively small amount of supporting material behind the trailing portion of the insert that can support the trailing portion to reduce the deformation and hence the tensile stresses, and buttress the trailing portion. As such, the produced tensile stress will many times be of such a magnitude so as to cause the trailing section of heel insert 116 to break or chip away. This is especially the case with inserts that are coated with a layer of super abrasive, such as polycrystalline diamond (PCD), which is known to be relatively weak in tension. Breakage of the trailing portion or loss of the highly wear resistant super abrasive coating, or both, leads to further breakage and wear, and thus accelerates the loss of the bit's ability to hold gage.

It will be understood that the views illustrated in FIGS. 1A–C do not necessarily represent the cutter path from a uniform perspective. FIGS. 1A–C represent different segments of the cutter path arranged so as to best illustrate the concepts related to compressive and tensile stresses relative to the direction of cutting movement.

The orientation of leading compression and trailing tension zones 64, 66 relative to cone axis 22 and the degree of each zone's arcuate extension around insert 62 are dependent upon the design and geometry of rolling cone 14. The preferred relative orientation of the leading compression and trailing tension zones within the bit has been determined by the study of cutter element wear patterns and by computer modeling of the cutting paths taken by cutter elements in the cone of a rolling cone bit. By way of illustration, reference is now made to FIG. 1D, in which these concepts are shown in a view looking down the bit axis at rolling cone 14. FIG. 1D generally illustrates the leading compression and trailing tension zones of a cutter element $\mathbf{60}_1$ as divided by imaginary line 23. The portions of cutter element $\mathbf{60}_1$ that are designated leading compression and trailing tension zones in FIG. 1D correspond to the portions that have been determined to be subjected to relatively large compressive or tensile stress in the direction of cutting movement, respectively, in most bits.

To quantify the relative orientation of the leading compression zone and to establish a method of measurement, FIG. 1E will serve as a frame of reference for the following discussion. FIG. 1E constitutes the projection of cutter element $\mathbf{60}_1$, imaginary line 23, and cone axis 22 onto a plane perpendicular to the bit axis. This projection is taken with cutter element $\mathbf{60}_1$ positioned at its furthermost point from the hole bottom. The imaginary line projection and the cone axis projection onto this plane are designated 23*p* and 22*p*, respectively and form an angle $\phi_1$ therebetween, as shown in FIG. 1E. To achieve at least a portion of the benefit of this invention, it will be understood that the value of angle $\phi_1$, as measured relative to cone axis projection 22*p*, can range from zero degrees to as much as 90 degrees, depending the precise configurations of the cutter element, cone and bit. In a typical preferred embodiment, angle $\phi_1$ ranges from approximately 35 to 80 degrees, and is most preferably approximately 60 degrees. Correspondingly, a radial line through the centerpoint of the leading compression zone 64 forms an angle $\phi_2$ with respect to cone axis projection 22*p*. In a typical preferred embodiment, angle $\phi_2$ ranges from approximately 10 to 55 degrees, and is most preferably approximately 30 degrees, as shown in FIG. 1E.

Heel cutter 62, one embodiment of the present invention, differs significantly from conventional inserts, as best described with reference to FIGS. 3–5. Specifically, the transition between wear face 63 and leading face 65 (leading compression zone 64) is much sharper than the transition between wear face 63 and trailing face 67 (trailing tension zone 66). As used herein to describe a portion of a cutter element's cutting surface, the term "sharper" indicates that either (1) the angle defined by the intersection of two lines or planes or (2) the radius of curvature of a contoured interface, is smaller than a comparable measurement on another portion of cutting surface to which it is compared.

In the embodiment shown in FIGS. 3–5, the relative sharpness of the leading compression zone as compared to the trailing tension zone, is manifest in the relative magnitudes of inside angles $\alpha_L$ and $\alpha_T$ (FIG. 5), which measure the angles between wear face 63 and leading face 65 and between wear face 63 and trailing face 67, respectively. According to the embodiment shown in FIG. 5, angles $\alpha_L$ and $\alpha_T$ are 100° and 135°, respectively. It will be understood that angles $\alpha_L$ and $\alpha_T$ can be varied, so long as $\alpha_T$ is greater than $\alpha_L$.

It is preferred that the cutting surface 68 of insert 62 between leading face 65 and trailing face 67 be "contoured" or "sculpted," such that the cutting surface 68 of insert 62 is substantially free of any nontangential intersections. The term "nontangential" is intended to describe those interfaces that cannot be described as continuous curves.

Non-circular wear faces are most clearly shown in FIGS. 7–9, wherein it can be seen that wear face 63 need not be circular and that the principles of the present invention can be applied to an insert regardless of the relative circumferences of the leading and trailing faces of the insert. In FIG. 7 curved leading face 65 has a greater radius of curvature than curved trailing face 67, in FIG. 6 the leading and trailing radii of curvature are equal and in FIG. 8 curved trailing face 67 has a greater radius of curvature than that of leading face 65. While the embodiments shown in FIGS. 7 and 8 have ovoid wear faces 63, other embodiments incorporating the principles of the present invention could be made having wear faces 63 of other shapes. For example, FIG. 9 shows an embodiment in which the leading and trailing faces intersect nontangentially. It will be understood by those skilled in the art that each of the inserts shown in FIGS. 7–9 could be formed so as to have the cross-section shown in FIG. 5. Furthermore, the embodiments shown FIGS. 3–8 have leading and trailing faces 65, 67 that comprise sections of cones, with each face being defined by a straight line when a cross section of the cutter is taken through its axis as in FIG. 5. In the alternative, leading and trailing faces 65, 67 can be curved in two directions, in the manner shown in FIGS. 10–11, described below.

The embodiments of the invention thus described are structured such that the center 63*a* of wear face 63 is shifted toward the leading face 65 relative to the cutter element's axis 61*a*. For example, as illustrated in FIG. 3 the axis 61*a* of the cutter insert, as defined by the axis of its base, does not coincide with the center 63*a* of wear face 63. Instead, axis 61*a* is well behind center 63*a*. This is in contrast to previously known inserts, in which the center 63*a* of the wear face 63 either coincides with the insert axis 61*a* or is located behind the axis toward the trailing tension zone. Further, the benefit of this geometry is that the potentially damaging tensile stress normally induced in the trailing portion of previously known inserts, the portion that is typically subject to the greatest tensile stress in the direction of cutting movement, is eliminated or reduced to a survivable level.

Referring now to FIGS. 10–11, a fourth preferred embodiment of the present insert uses rounded leading compression and trailing tension zones 64, 66 respectively and rounded leading and trailing faces 65, 67 respectively. In FIGS. 10–12 and subsequent Figures, items common to the embodiment shown in FIGS. 3–5 are indicated by like reference numerals. Because the leading compression and trailing tension zones 64, 66 are rounded, the relative sharpness of the leading compression and trailing tension zones is manifest in the relative magnitudes of $r_L$ and $r_T$ (FIG. 11), which are the radii of curvature of the leading compression and trailing tension zones, respectively. According to a preferred embodiment, radius $r_L$ and $r_T$ are 0.02 and 0.09 inches respectively. It will be understood that radii $r_L$ and $r_T$ can be varied, so long as $r_L$ is smaller than $r_T$. It will further be understood that embodiments exist, such as that shown in FIG. 12, in which the zones 64, 66 are rounded and leading radius $r_L$ is greater than $r_T$, but the desired relative sharpnesses of the leading compression and trailing tension zones is maintained because of the relative magnitudes of angles $\alpha_L$ and $\alpha_T$, $\alpha_L$ being less than $\alpha_T$. It will be further understood that the present invention does not require that both zones be rounded, or both angled, so long as the leading compression zone is sharper than the trailing tension zone. For example, one or both zones 64, 66 can include a chamfer, which can affect the sharpness of the transition by its depth. Likewise, if the curvature of the transition is not constant, but is elliptical or otherwise curved, the curvature of the transition may not be a pure radius. It will be understood that in such instances, the smallest radius of curvature for each transition may be used for comparative purposes, or the position of the center of the wear face with respect to the axis of the base may be considered, if that measurement is more direct.

FIGS. 13–15 illustrate that the advantages of the present invention can be maintained even where the insert is formed so as to have significant amounts of positive or negative rake angle in the leading edge. Specifically, FIGS. 13A and 13B show cutter elements having a positive rake angle on its leading face 65. The embodiment of FIG. 13B includes a concave surface on leading face 65. The embodiment shown in FIG. 14 has a more negative rake angle than that shown in FIG. 5, but still conforms to the principles of the present invention, as $\alpha_L$ is less than $\alpha_T$. FIG. 15 shows a cutter element having an extremely aggressively shaped leading face 65, similar to the leading edge of FIG. 13A, but having a radiused intersection with wear face 63 to reduce stress and to diminish the possibility of breakage. Increasing the positive rake angle of the leading face 65 makes the cutting action more aggressive, which in turn increases ROP potential of the bit.

Referring now to FIGS. 17, 18 and 19A–C, an alternative construction of the present cutter element has an essentially chisel-shaped configuration. The chisel-shaped insert 90 has an outer wear face 92 generally oriented so as to face the borehole wall during the portion of the cutting cycle in which the cutter contacts the wall, an inner face 93 substantially opposite the outer wear face, a crest 94, and leading and trailing faces 98, 99, respectively. According to the present invention and as shown in FIG. 17A, chisel-shaped insert 90 is oriented in the rolling cone so that its crest is perpendicular to a projection 22*a* of the axis of the cone. Thus, insert 90 further includes a crest compression zone 95 between leading face 98 and crest 94 and a crest tension zone 96 between trailing face 99 and crest 94. In addition, the intersections of the outer wear face 92 and inner face 93 with the leading and trailing faces 98, 99 define four edges, identified as outer leading compression edge 100, inner leading edge 102, outer trailing tension edge 104 and inner trailing edge 106. As described above, the crest compression zone 95 is sharper than crest tension zone 96. The insert of this embodiment can be made symmetrical, so that each pair of leading and trailing edges 100/102 and 104/106 is substantially the same. Alternatively, as described with respect to the previous embodiments, this chisel-shaped insert 90 can be modified in a similar manner such that the outer trailing tension edge is adapted so as to further reduce the tensile stress produced in the insert, as shown in FIGS. 19A–C. FIG. 19A shows an embodiment in which outer trailing tension edge 104 is contoured with a larger radius of curvature than that of outer leading compression edge 100 and FIG. 19B shows an embodiment in which the same intersection 104 is made essentially planar by eliminating a portion of the insert at the corner. FIG. 19C shows an embodiment in which the leading face 98 has a positive rake angle, illustrated at transition 100. Insert 90 is believed best employed in the position of nestled gage row 70*a*, although insert 90 may also be employed in other rows as well, including in heel row 60*a*, off-gage row 80*a*, and conventional gage rows.

By changing the geometry of the trailing portion of a heel cutter insert 60 or nestled insert 70, for example, in the manner described above, the portion of the insert placed in greatest tensile stress in the direction of cutting movement during drilling is removed. In this manner, the tensile stresses that would otherwise be produced in the insert can be relieved without adversely affecting the amount of mechanical support provided to leading compression zone 64 by the body of cutter 62. It is this relationship that results in the improvement in cutter life and the desired features of the present invention.

The failure mode of cutter elements usually manifests itself as either breakage, wear, or mechanical or thermal fatigue. Wear and thermal fatigue are typically results of abrasion and friction as the elements act against the formation material. Breakage, including chipping of the cutter element, typically results from loads causing tensile stresses, including impact loads, although thermal and mechanical fatigue of the cutter element can also initiate breakage. The trailing edge of prior art inserts is subjected to a combination of abrasive wear, frictional heat, tensile stresses and impact forces from the cutting action. On tungsten carbide inserts, the frictional heat combined with rapid cooling by the drilling fluid can lead to thermal fatigue, initiating a network of micro cracks on the surface. Frictional forces on the surface of the trailing tension zone place the trailing portion of the insert under tensile stress, causing the cracks to propagate by mechanical fatigue leading to chipping or breakage. Prior art inserts coated with polycrystalline diamond (PCD) are especially prone to chipping and breakage of the tailing portion due to tensile stresses in the trailing tension zone and impact forces from the cutting action.

The present invention addresses the above failure modes by significantly reducing the tensile stress in the direction of cutting movement in the trailing portion of the insert. The new geometry of the trailing section provides structural support to better enable the insert to withstand frictional forces that cause tensile stress and impact forces that result from the cutting action. Due to a lesser area being presented to the formation by the trailing tension zone and a larger trailing face exposed to drilling fluid, the frictional heat is reduced and more efficiently dissipated and therefore the potential of thermal fatigue is reduced. Even if thermal fatigue should occur, the new geometry of the present insert is better suited to withstand the mechanical loading that causes the tensile stress component and leads to chipping and breakage. The new and improved geometry of the trailing portion provides increased opportunities for inserts with superabrasive coatings, such as PCD and PCBN, since the principal factors that cause the superabrasive coating to fail are greatly reduced.

The present cutter element is a departure from prior art multi-cone bit cutter elements that have generally either required that the leading and trailing portions of the cutter element be symmetrical, or have provided a trailing portion that is sharper than the leading portion. In other systems, attempts have been made to reduce the tensile stresses and premature failure in the heel row inserts by inclining the whole cutter element so that its trailing portion is at a greater distance from the borehole wall than is its leading portion. These prior art devices, however, have the adverse affect of forcing the leading edge of wear face 63 to do all of the work associated with scraping and/or reaming the borehole sidewall, with the result that the surface area of each cutter element is back-relieved and not in full contact with the borehole wall and therefore is not available to help resist abrasive wear caused by contacting the formation. In the present invention, the positioning of wear face 63 with respect to the borehole wall is maintained so that virtually the entire wear face 63 can operate on the borehole sidewall.

A particularly preferred embodiment of the present invention includes use of cutter elements in accordance with the present invention in a bit having gage and off-gage cutter elements positioned to separate sidewall and bottom hole cutting duty. A bit of this sort is fully disclosed and described in commonly owned copending application filed on Apr. 10, 1996, Ser. No. 08/630,517, and entitled Rolling Cone Bit with Gage and Off-gage Cutter Elements Positioned to Separate Sidewall and Bottom Hole Cutting Duty, which is hereby incorporated by reference as if fully set forth herein. The cutter elements of the present invention, having a relatively sharper leading section and relatively less sharp trailing section, can be used advantageously in place of any one or more of heel row cutter elements or gage row cutter elements, as described in the copending application. In addition, it will be understood that the cutter elements of the present invention can be used in bits that have more than one heel row.

Referring now to FIGS. 20 and 21, another embodiment of an insert constructed according to the principles of the present invention comprises an insert 200. The configuration of insert 200 makes it especially suited for use in the nestled row, such as inserts 70 in FIG. 1, but it can likewise be employed with benefit in other rows as well. Insert 200 includes a base 261 and a cutting surface 268. As described previously, base 261 is preferably cylindrical and includes a longitudinal axis 261*a*. Cutting surface 268 of insert 200 extends beyond shoulder 50 of cone 14 and includes a slanted or inclined wear face 263, a frustoconical side surface 280 including a leading face 265 and a trailing face 269, and a circumferential transition surface 267. Wear face 263 can be slightly convex or concave, but is preferably substantially flat. Wear face 263, although inclined as compared to previous embodiments, is oriented in the cone so as to hug the gage curve and resist abrasive wear by projecting a substantial area against the formation. As best shown in FIG. 20, wear face 263 is inclined at an angle a with respect to a plane perpendicular to axis 261*a*, and frustoconical side surface 280 defines an angle β with respect to axis 261*a*. As shown, β indicates the angle between axis 261*a* and the leading face 265 of surface 280. It will be understood that leading face 265 can alternatively have a positive rake angle, similar to those shown in FIGS. 13A, 13B and 15, discussed above. Likewise, the surface 280, including leading face 265 and trailing face 269, need not be frustoconical, but can be rounded or contoured in the manner illustrated in FIGS. 10 and 11, and the angle β between surface 280 and axis 261*a* need not be constant around the circumference of the insert.

Circumferential transition surface 267 forms the transition from wear face 263 to leading face 265 on one side of insert 200 and from wear face 263 to trailing face 269 on the opposite side of insert 200. Circumferential shoulder 267 includes a leading compression zone 264 and a trailing tension zone 266 (FIG. 21). It will be understood that, as above, the terms "leading compression zone" and "tailing tensile zone" do not refer to any particularly delineated section of the cutting face, but rather to those zones that undergo the larger stresses (compressive and tensile, respectively) associated with the direction of cutting movement. The position of compression and tension zones 264, 266 relative to the axis of rolling cone 14, and the degree of their circumferential extension around insert 200 can be varied without departing from the scope of this present invention.

Referring briefly to FIGS. 21 and 1E, in a typical preferred configuration, a radial line 270 through the center of leading compression zone 264 lies approximately 10 to 55 degrees, and most preferably approximately 30 degrees, clockwise from the projection 22*a* of the cone axis, as indicated by the angle θ in FIG. 21. A line 272 through the center of trailing tension zone 266 preferably, but not necessarily, lies diametrically opposite leading center 270.

In accordance with the present invention, leading compression zone 264 is sharper than trailing tension zone 266. Because compression and tension zones 264 and 266 are rounded, their relative sharpness is manifest in the relative magnitudes of $r_L$ and $r_T$ (FIG. 20), which are radii of curvature of the leading compression and trailing tension zones, respectively and $\alpha_L$ and $\alpha_T$,, which measure the inside angle between wear face 263 and leading and trailing faces. Shoulder 267 is preferably contoured or sculpted, so that the progression from the smallest radius of curvature to the largest is smooth and continuous around the insert. For a typical 5/16" diameter insert constructed according to a preferred embodiment, the radius of curvature of surface 267 at a plurality of points $c_{1-4}$ (FIG. 21) is given in the following Table I.

TABLE 1

| Point | Radius of Curvature (in.) |
|---|---|
| $c_1$ | .050 |
| $c_2$ | .050 |
| $c_3$ | .120 |
| $c_4$ | .080 |

By way of further example, for a typical 7/16" diameter insert constructed according to the present invention, the radii at points $c_{1-4}$ are given in the following Table II.

TABLE II

| Point | Radius of Curvature (in.) |
|---|---|
| $c_1$ | .050 |
| $c_2$ | .050 |
| $c_3$ | .160 |
| $c_4$ | .130 |

An optimal embodiment of the present invention requires balancing competing factors that tend to influence the shape of the insert in opposite ways. Specifically, it is desirable to construct a robust and durable insert having a large wear face 263, an aggressive but feasible leading compression zone 264, and a large $r_T$ so as to mitigate tensile stresses in the direction of cutting movement in trailing tension zone 266. Changing one of these variables tends to affect the others. One skilled in the art will understand that the following quantitative amounts are given by way of illustration only and are not intended to serve as limits on the individual variables so illustrated.

Thus, by way of illustration, in one preferred embodiment, angle α is between 5 and 45 degrees and more preferably approximately 23 degrees, while angle β on the leading side is between 0 and 25 degrees and more preferably approximately 12 degrees. According to a preferred embodiment, the smallest radius of curvature $r_L$ for a 5/16 inch insert is 0.050 inches and the largest radius of curvature $r_T$ is 0.120 inches. It will be understood that radii $r_L$ and $r_T$ can be varied, so long as $r_L$ is smaller than $r_T$. It will further be understood that embodiments exist, similar to that shown in FIG. 12, in which the zones 264, 266 are rounded and trailing radius $r_L$ is greater than $r_T$, but the desired relative sharpnesses of the leading compression and trailing tension zones is maintained because of the relative magnitudes of angles $\alpha_L$ and $\alpha_T$, $\alpha_L$ being less than $\alpha_T$. It will be further understood that the present invention does not require that both zones be rounded, or both angled, so long as the leading compression zone is sharper than the trailing tension zone.

Insert 200 optionally includes a pair of marks 274, 276 on cutting surface 268, which align with the projection 22*a* of the cone axis. Marks 274, 276 serve as a visual indication of the correct orientation of the insert in the rolling cone cutter during manufacturing. It is preferred to include marks 274 and 276, as the asymmetry of insert 200 and its unusual orientation with respect to the projection 22*a* of the cone axis would otherwise make its proper alignment counter-intuitive and difficult. Marks 274, 276 preferably constitute small but visible grooves or notches, but can be any other suitable mark. The insert 200 is preferably used in the nestled gage position indicated as 70 in FIG. 1, but can alternatively be used to advantage in other cutter positions. In a preferred embodiment, marks 274 and 276 are positioned 180 degrees apart.

FIG. 22 shows an insert 200 in the nestled position on a steel tooth cone and shows its relationship to gage curve 5*a*. As understood by those skilled in the art of designing bits, a "gage curve" is commonly employed as a design tool to ensure that a bit made in accordance to a particular design will cut the specified hole diameter. The gage curve is a complex mathematical formulation which, based upon the parameters of bit diameter, journal angle, and journal offset, takes all the points that will cut the specified hole size, as located in three dimensional space, and projects these points into a two dimensional plane which contains the journal centerline and is parallel to the bit axis. The use of the gage curve greatly simplifies the bit design process as it allows the gage cutting elements to be accurately located in two dimensional space which is easier to visualize.

Wear face 263 hugs the gage curve 5*a*, meaning that wear face 263 follows the contour of the gage curve when viewed in rotated profile as shown in FIG. 22. Wear face 263 thus provides a large area for frictional engagement. Use of the present cutter elements in steel tooth bits is described in greater detail below.

Referring now to FIGS. 23 and 24, an alternative embodiment 300 of insert 200 includes the features of insert 200, plus one or more relieved or beveled trailing sub-zones. Specifically, insert 300 includes a body 361, wear face 363, leading face 365, transition surface 367 and compression and tension zones 364, 366, respectively. In the embodiment shown, transition surface 367 includes relieved sub-zones 368*a*, 368*b* that each comprise a slightly flattened region in the trailing tension zone 366. Relieved sub-zones 368*a*, 368*b* effectively reduce the portion of trailing tension zone 366 that is subjected to the largest tensile stress in the direction of cutting movement by increasing the included angle between wear face 363 and sub-zone 368. In addition, wear face 363 may be slightly convex, as shown in this embodiment, allowing further relief of the trailing portions of the cutter element. It will be understood that sub-zones 368*a*, 368*b* also need not be flat, but can be slightly convex. Alternatively, rather than providing two distinct sub-zones 368*a*, 368*b*, insert 300 can include a single continuous or contoured sub-zone 368 that extends or covers the regions shown as sub-zones 368*a*, 368*b* in FIG. 23.

The various cutter elements and the present invention may be employed in steel tooth bits as well as TCI bits as will be understood with reference to FIGS. 16 and 22. As shown, a steel tooth cone 130 is adapted for attachment to a bit body 12 in a like manner as previously described with reference to cones 14–16. When the invention is employed in a steel tooth bit, the bit includes a plurality of cutters such as rolling cone cutter 130. Cutter 130 includes a backface 40, a generally conical surface 46 and a heel surface 44 which is formed between conical surface 46 and backface 40, all as previously described with reference to the TCI bit shown in FIGS. 1–2. Similarly, steel tooth cone cutter 130 includes heel row inserts 60 embedded within heel surface 44, and nestled row cutter elements 70, such as inserts 200 disposed adjacent to the circumferential shoulder 50 as previously defined. Although depicted as inserts, nestled cutter elements 70 may likewise be steel teeth or some other type of cutter element. In addition to cutter elements 60, 70, steel tooth cutter 130 includes a plurality of gage row cutter elements 120 generally formed as radially-extending teeth. Steel teeth 120 include an outer layer or layers of wear resistant material 120*a* to improve durability of cutter elements 120.

Steel tooth cutters such as cutter 130 have particular application in relatively soft formation materials and are preferred over TCI bits in many applications. Nevertheless, even in relatively soft formations, in prior art bits in which the gage row cutters consisted of steel teeth, the substantial sidewall cutting that must be performed by such steel teeth may cause the teeth to wear to such a degree that the bit becomes undersized and cannot maintain gage. The benefits and advantages of the present invention that were previously described with reference to a TCI bit apply equally to steel tooth bits. Namely, any of heel row cutters 60 and nestled row cutters 70 can be configured in accordance with the principles set out herein if it is desired to reduce the effects of tensile stress in the direction of cutting movement on the trailing tension zone of the cutter elements.

While various preferred embodiments of the invention have been shown and described, modifications thereof can be made by one skilled in the art without departing from the spirit and teachings of the invention. The embodiments described herein are exemplary only, and are not limiting. Many variations and modifications of the invention and apparatus disclosed herein are possible and are within the scope of the invention. Accordingly, the scope of protection is not limited by the description set out above, but is only limited by the claims which follow, that scope including all equivalents of the subject matter of the claims.

What is claimed is:

1. A shaped cutter element for use in a rolling cone drill bit, comprising:

a cutting surface, said cutting surface including a wear face and a side surface, said side surface including leading and trailing faces, the interface between said leading face and said wear face forming a leading compression zone and the interface between said trailing face and said wear face forming a trailing tension zone;

wherein said leading compression zone is sharper than said trailing tension zone.

2. The cutter element according to claim 1 wherein substantially all of said wear face follows the contour of the gage curve.

3. The cutter element according to claim 1 wherein said cone has a cone axis and the cutter element has an longitudinal axis and wherein said leading compression zone has a compression center and a radial line through said longitudinal axis and said compression center lies approximately 10 to 55 degrees clockwise from a projection of said cone axis onto a plane perpendicular to the bit axis when said cutter element is at its furthermost point from the hole bottom.

4. The cutter element according to claim 3 wherein said line lies approximately 30 degrees from the projection of the cone axis.

5. The cutter element according to claim 3 wherein said wear face is substantially flat.

6. The cutter element according to claim 3 wherein said wear face is inclined with respect to a plane perpendicular to said longitudinal axis.

7. The cutter element according to claim 6 wherein said cutting surface is free of non-tangential intersections.

8. The cutter element according to claim 6 wherein said cutter element is used in a nestled row of a rolling cone cutter, said nestled row being positioned to assist in cutting the corner of the borehole.

9. The cutter element according to claim 8, wherein said cutter element is used in a plurality of the cutter element positions in said nestled row.

10. The cutter element according to claim 6, wherein at least a portion of said cutter element is coated with a wear resistant superabrasive layer.

11. The cutter element according to claim 10 wherein said wear resistant superabrasive layer comprises polycrystalline diamond.

12. The cutter element according to claim 10, wherein said wear resistant superabrasive layer comprises cubic boron nitride.

13. The cutter element according to claim 1, wherein each of said zones comprises a contoured intersection of a flat plane and a section of a cone and the inside angle between said plane and said cone section at said leading compression zone is smaller than the inside angle between said plane and said cone section at said trailing tension zone, said inside angles being measured in a plane that includes the longitudinal axis of the cutter element.

14. The cutter element according to claim 1, wherein each of said zones comprises a contoured corner having a radius of curvature and the largest radius of curvature of said leading compression zone is smaller than the smallest radius of curvature of said trailing tension zone.

15. The cutter element according to claim 1 wherein said leading face is formed to have a positive rake angle.

16. The cutter element according to claim 1 wherein said leading face includes a concave portion.

17. A shaped cutter element for use in a cone for a rolling cone drill bit, the element having an element axis and comprising:

a base portion, said base portion being adapted to extend into a matching socket in the bit cone;

a cutting portion adapted to extend beyond said socket, said cutting portion defining a cutting surface, said cutting surface including a wear face, a leading face and leading compression and trailing tension zones;

wherein said leading compression zone is sharper than said trailing tension zone; and wherein the element axis intersects said wear face.

18. The cutter element according to claim 17 wherein substantially all of said wear face follows the contour of the gage curve.

19. The cutter element according to claim 18 wherein said wear face is substantially flat and inclined with respect to a plane perpendicular to the longitudinal axis of said base portion.

20. The cutter element according to claim 19 wherein said wear face is inclined at an angle of between 5 and 45 degrees.

21. The cutter element according to claim 19 wherein said leading face is substantially frustoconical.

22. The cutter element according to claim 21 wherein said leading face defines an angle of between 0 and 25 degrees with the longitudinal axis of said base portion.

23. The cutter element according to claim 17 wherein said cone has a cone axis and the cutter element has a longitudinal axis and wherein said leading compression zone has a compression center and a radial line through said longitudinal axis and said compression center lies approximately 10 to 55 degrees clockwise from a projection of said cone axis onto a plane perpendicular to the bit axis when said cutter element is at its furthermost point from the hole bottom.

24. The cutter element according to claim 23 wherein said line lies approximately 30 degrees from the cone axis.

25. The cutter element according to claim 17, wherein each of said zones comprises a contoured intersection of a flat plane and a section of a cone and the inside angle between said plane and said cone section at said leading compression zone is smaller than the inside angle between said plane and said cone section at said trailing tension zone, said inside angles being measured in a plane that includes the longitudinal axis of the cutter element.

26. The cutter element according to claim 17, wherein each of said zones comprises a contoured corner having a radius of curvature and the largest radius of curvature of said leading compression zone is smaller than the smallest radius of curvature of said trailing tension zone.

27. The cutter element according to claim 17, wherein said cutter element is used in a nestled row of a rolling cone cutter.

28. The cutter element according to claim 25 wherein said cutter element is used in a plurality of the cutter element positions in said nestled row.

29. The cutter element according to claim 17 wherein said cutting surface is free of non-tangential intersections.

30. The cutter element according to claim 17 wherein said leading face is formed to have a positive rake angle.

31. The cutter element according to claim 17 wherein said leading face includes a concave portion.

32. An earth boring bit for drilling a borehole, the bit comprising:

a bit body having a bit axis;

at least one rolling cone cutter rotatably mounted on said bit body and having a generally conical surface and an adjacent heel surface;

a plurality of heel cutter elements positioned on said heel surface; and a plurality of nestled cutter elements;

at least one of said cutter elements comprising a base and a cutting surface having a wear face and leading compression and trailing tension zones, said leading compression zone being sharper than said trailing tension zone and said wear face being inclined with respect to a plane perpendicular to the axis of said base, said cutting surface being free of non-tangential intersections.

33. The bit according to claim 32 wherein any of said cutter elements is coated with a superabrasive layer.

34. The bit according to claim 33 wherein said superabrasive layer comprises polycrystalline diamond.

35. The bit according to claim 33 wherein said superabrasive layer comprises cubic boron nitride.

36. The cutter element according to claim 32, wherein each of said zones comprises a contoured intersection of a flat plane and a section of a cone and the inside angle between said plane and said cone section at said leading compression zone is smaller than the inside angle between said plane and said cone section at said trailing tension zone, said inside angles being measured in a plane that includes the longitudinal axis of the cutter element.

37. The cutter element according to claim 32, wherein each of said zones comprises a contoured corner having a radius of curvature and the largest radius of curvature of said leading compression zone is smaller than the smallest radius of curvature of said trailing tension zone.

* * * * *